US007402112B2

(12) United States Patent
Galloway

(10) Patent No.: US 7,402,112 B2
(45) **Date of Patent: *Jul. 22, 2008**

(54) MULTIPLE MATERIAL GOLF CLUB HEAD

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/872,605

(22) Filed: Oct. 15, 2007

(65) Prior Publication Data

US 2008/0032819 A1 Feb. 7, 2008

Related U.S. Application Data

(63) Continuation of application No. 11/539,682, filed on Oct. 9, 2006, now Pat. No. 7,320,646, which is a continuation of application No. 10/710,352, filed on Jul. 2, 2004, now Pat. No. 7,118,493, which is a continuation-in-part of application No. 10/065,871, filed on Nov. 26, 2002, now Pat. No. 6,758,763, which is a continuation-in-part of application No. 09/906,889, filed on Jul. 16, 2001, now Pat. No. 6,491,592, which is a continuation-in-part of application No. 09/431,982, filed on Nov. 1, 1999, now Pat. No. 6,354,962.

(51) Int. Cl.
*A63B 53/04* (2006.01)
*A63B 69/36* (2006.01)

(52) U.S. Cl. ..... 473/224; 473/324; 473/329; 473/342; 473/349; 473/345

(58) Field of Classification Search ..... 473/324–350, 473/288–291, 224, 234
See application file for complete search history.

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |
| 2,750,194 | A | 6/1956 | Clark |
| 3,692,306 | A | 9/1972 | Glover |
| 3,897,066 | A | 7/1975 | Belmont |
| 3,937,474 | A | 2/1976 | Jepson et al. |
| 3,975,023 | A | 8/1976 | Inamori |
| 3,989,248 | A | 11/1976 | Campau |
| 4,021,047 | A | 5/1977 | Mader |
| 4,398,965 | A | 8/1983 | Campau |

(Continued)

*Primary Examiner*—Sebastiano Passaniti
(74) *Attorney, Agent, or Firm*—Michael A. Catania; Elaine H. Lo

(57) ABSTRACT

A golf club (40) having a club head (42) with a face component (60), an aft body (61), and a sound modifying component (59) is disclosed herein. The face component (60) has a striking plate portion (72) and a return portion (74). The aft-body (61) is composed of a crown portion (62), a sole portion (64) and optionally a ribbon section (90). The face component (60) is composed of a metal material, and the aft-body (61) is composed of a non-metal material such as a composite material or a thermoplastic material. The sound modifying component (59), which is attached to the metallic face component (60), alters the sound of the golf club head (42) when it impacts a golf ball.

12 Claims, 17 Drawing Sheets

U.S. PATENT DOCUMENTS 4,438,931 A * 3/1984 Motomiya ..... 473/346
4,568,088 A 2/1986 Kurahashi
4,872,685 A 10/1989 Sun
4,877,249 A 10/1989 Thompson
5,106,094 A 4/1992 Desbiolles et al.
5,193,811 A 3/1993 Okumoto et al.
5,282,624 A 2/1994 Viste
5,346,216 A 9/1994 Aizawa
5,377,986 A 1/1995 Viollaz et al.
5,464,210 A 11/1995 Davis et al.
5,474,296 A 12/1995 Schmidt et al.
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,718,641 A * 2/1998 Lin ..... 473/224
5,743,813 A 4/1998 Chen et al.
5,830,084 A 11/1998 Kosmatka
5,836,830 A 11/1998 Onuki et al.
5,888,148 A 3/1999 Allen
5,908,356 A * 6/1999 Nagamoto ..... 473/224
5,989,134 A * 11/1999 Antonious ..... 473/327
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,310,185 B1 10/2001 Wallace et al.
6,332,847 B2 12/2001 Murphy et al.
6,332,848 B1 12/2001 Long et al.
6,348,015 B1 2/2002 Kosmatka
6,354,962 B1 * 3/2002 Galloway et al. ..... 473/342
6,390,933 B1 5/2002 Galloway et al.
6,406,381 B2 6/2002 Murphy et al.
6,471,604 B2 10/2002 Hocknell et al.
6,491,592 B2 * 12/2002 Cackett et al. ..... 473/342
6,565,452 B2 5/2003 Helmstetter et al.
6,582,323 B2 6/2003 Soracco et al.
6,602,149 B1 8/2003 Jacobson
6,623,378 B2 9/2003 Beach et al.
6,739,982 B2 * 5/2004 Murphy et al. ..... 473/342
6,758,763 B2 * 7/2004 Murphy et al. ..... 473/342
6,994,637 B2 * 2/2006 Murphy et al. ..... 473/345
7,118,493 B2 * 10/2006 Galloway ..... 473/329
7,320,646 B2 * 1/2008 Galloway ..... 473/224

* cited by examiner

MULTIPLE MATERIAL GOLF CLUB HEAD

CROSS REFERENCES TO RELATED APPLICATIONS

The Present Application is a continuation application of U.S. patent application Ser. No. 11/539,682, filed on Oct. 9, 2006 now U.S. Pat. No. 7,320,646, which is a continuation application of U.S. patent application Ser. No. 10/710,352, filed on Jul. 2, 2004, now U.S. Pat. No. 7,118,493, which is a continuation-in-part application of U.S. patent application Ser. No. 10/065,871, filed Nov. 26, 2002, now U.S. Pat. No. 6,758,763, which is a continuation-in-part application of U.S. patent application Ser. No. 09/906,889, filed Jul. 16, 2001, now U.S. Pat. No. 6,491,592, which is a continuation-in-part application of U.S. patent application Ser. No. 09/431,982, filed Nov. 1, 1999, now U.S. Pat. No. 6,354,962.

STATEMENT REGARDING FEDERALLY SPONSORED RESEARCH OR DEVELOPMENT

Not Applicable

BACKGROUND OF THE INVENTION

1. Field of the Invention

The present invention relates to a multi-material golf club head with a sound modifying component. More specifically, the present invention relates to a golf club head with face component composed of a metal material for a more efficient transfer of energy to a golf ball at impact, a non-metallic aft-body to control the mass distribution, and a sound modifying component for altering the frequency, amplitude, and duration of the sound of the golf club head striking a golf ball.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials have damping (loss) properties that are strain and strain rate dependent, which are on the order of 10-100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a Golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head.

The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al., discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from de-laminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al., discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to provide a multiple material club head with a high coefficient of restitution greater forgiveness for the typical golfer, and a sound modifying component for a more pleasing sound when the golf club head strikes the golf ball.

BRIEF SUMMARY OF THE INVENTION

One aspect of the present invention is a golf club head composed of a metal face component and light-weight aft body, and having a coefficient of restitution of at least 0.81 under test conditions, such as those specified by the USGA. The standard USGA conditions for measuring the coefficient of restitution is set forth in the USGA Procedure for Measuring the Velocity Ratio of a Club Head for Conformance to Rule 4-1e, Appendix II. Revision I, Aug. 4, 1998 and Revision 0, Jul. 6, 1998, available from the USGA.

Another aspect of the present invention is a golf club head including a face component composed of a metal material, an aft-body composed of a non-metal material, and a sound-modifying component. The face component has a striking plate portion and a return portion. The striking plate portion has a thickness in the range of 0.010 inch to 0.250 inch. The return portion has a thickness in the range of 0.010 inch to 0.200 inch. The aft body has a crown portion, a sole portion and a ribbon portion. The aft-body is attached to the return portion of the face component. The sound modifying component is attached to the face component. The golf club head has a coefficient of restitution of 0.81 to 0.94. The sound modifying component is composed of a metal material. The sound modifying component alters the frequency, amplitude, and duration of sound made when the golf club head strikes a golf ball. The sound modifying component may be attached to the exterior surface of the face component. Alternatively, the sound modifying component may be attached to an interior surface of the face component.

Yet another aspect of the present invention is golf club head including a face component composed of a metal material and an aft-body composed of a plurality of plies of pre-preg. The face component has a striking plate portion and a return portion. The aft body has a crown portion, a sole portion and a ribbon portion. The aft-body is attached to the return portion of the face component. The moment of inertia of the golf club head about the Izz axis through the center of gravity is greater than 3000 grams-centimeter squared, and the moment of inertia about the Iyy axis through the center of gravity is greater than 1800 grams-centimeter squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
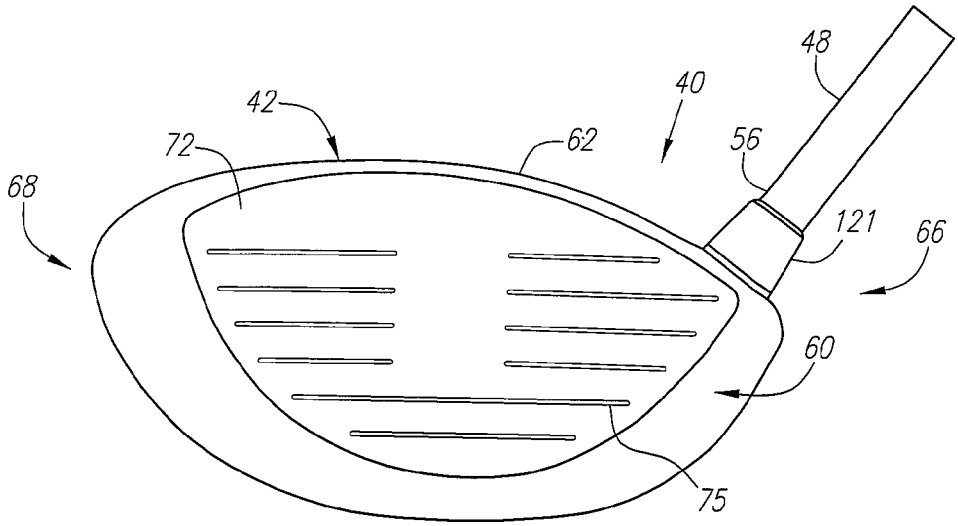
FIG. 1 is a front view of a golf club.

The present invention is generally directed to a multi-material golf club head that has a center of gravity positioned relatively close to a striking plate and a relatively high moment of inertia Iyy and Izz about the center of gravity of the golf club head. The golf club head of the present invention has discretionary mass located along the fore and aft portions of the club head, with the remainder of the club head being composed of a lightweight or lower density material. This improved mass distribution provides the golf club head with better inertial properties for back spin and sidespin optimization for variation of impact location on the club face. Additionally, the golf club head includes means for modifying the sound characteristics of the club head. The sound modifying means alters the sound emitted from the golf club head when the club strikes a golf ball.

As shown in FIGS. 1-14E, a golf club is generally designated 40. The golf club 40 has a golf club head 42 with a hollow interior, not shown. Engaging the club head 42 is a shaft 48 that has a grip, not shown, at a butt end and is inserted into a hosel 54 at a tip end 56.

The club head 42 is generally composed of three components, a face component 60, an aft-body 61, and means for modifying the sound characteristics of the club head 42. The aft-body 61 has a crown portion 62 and a sole portion 64. The club head 42 is preferably partitioned into a heel section 66 nearest the shaft 48, a toe section 68 opposite the heel section 66, and a rear section 70 opposite the face component 60. The means for modifying the sound characteristics preferably includes a sound modifying component 59, which is attached to the face component 60.

Variations of one embodiment of the golf club head of the present invention are illustrated in FIGS. 15A, 15B, 16, 16A, 16B, and 16C, which show a sound modifying component 59 located on an external surface of the golf club head 42. Variations of an alternative embodiment of the present invention are illustrated in FIGS. 17A and 17B. The alternative embodiment depicted in FIGS. 12A and 12B have the sound modifying component 58 located on an internal surface of the face component 60. Although two embodiments are illustrated, those skilled in the pertinent art will recognize from this disclosure that other embodiments of the golf club head of the present invention are possible without departing from the scope and spirit of the present invention. The sound modifying component 59 is described in greater detail below.

FIGS. 12, 13, 13A, 13B, 13C, 13D and 13E illustrate the face component 60 in isolation. The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon. The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

Figure 13:
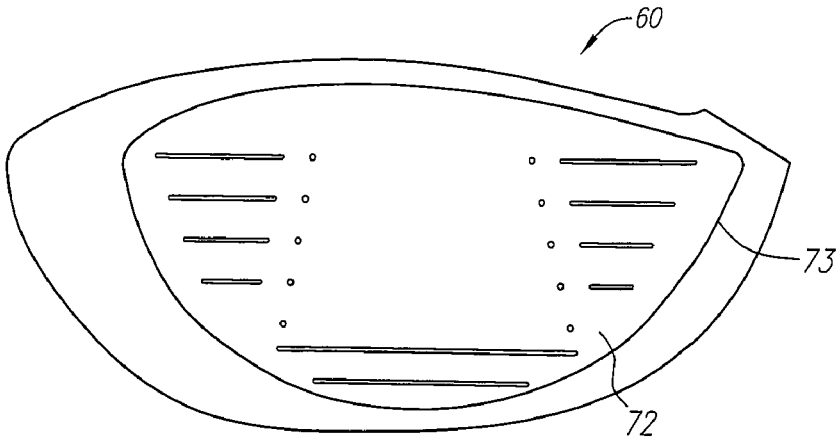
FIG. 13 is an isolated front view of a face component of the golf club head.
Figure 13A:
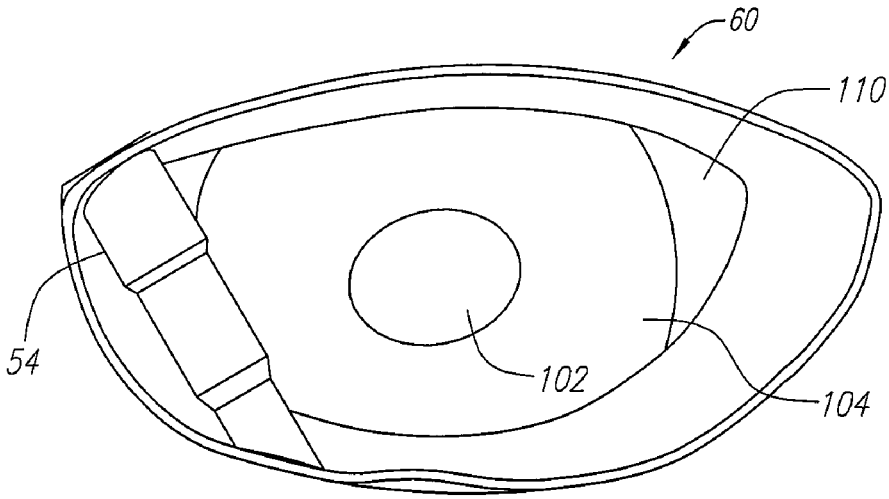
FIG. 13A is an interior view of the face component of FIG. 13.
Figure 13B:
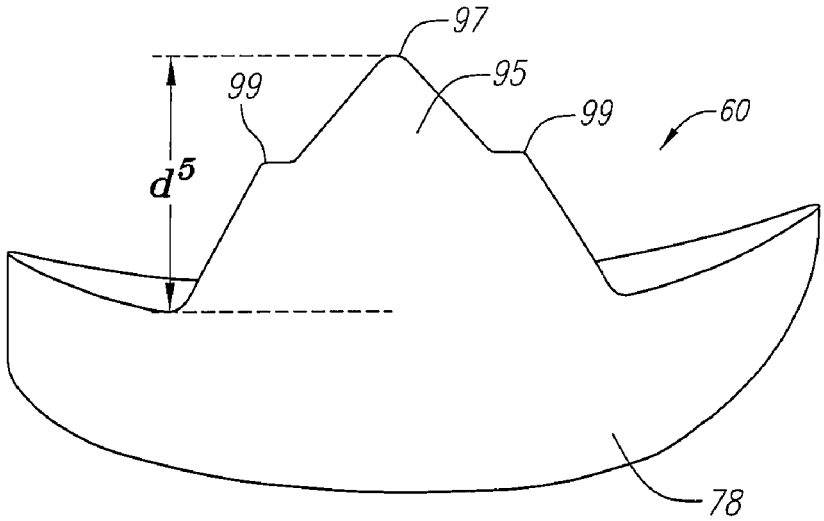
FIG. 13B is a bottom plan view of the face component of FIG. 13.
Figure 13C:
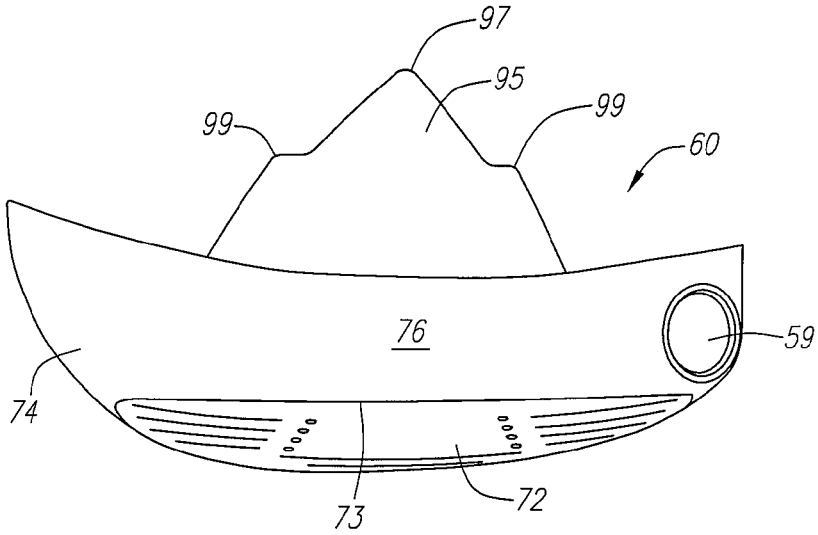
FIG. 13C is a top plan view of the face component of FIG. 13.
Figure 13D:
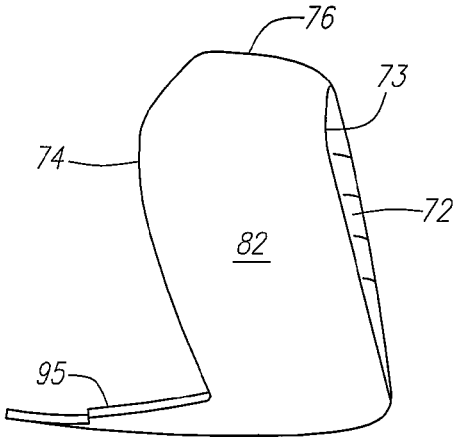
FIG. 13D is a toe side view of the face component of FIG. 13.
Figure 13E:
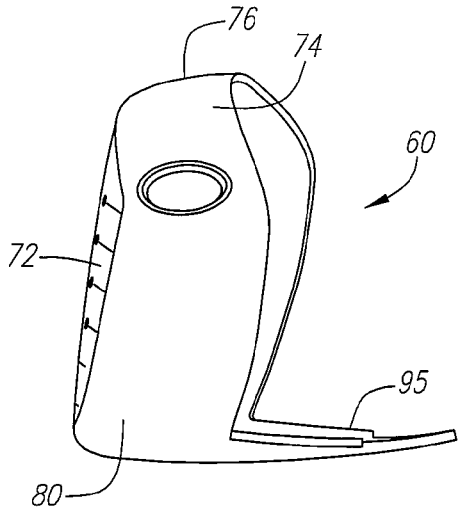
FIG. 13E is a heel side view of the face component of FIG. 13.
Figure 14:
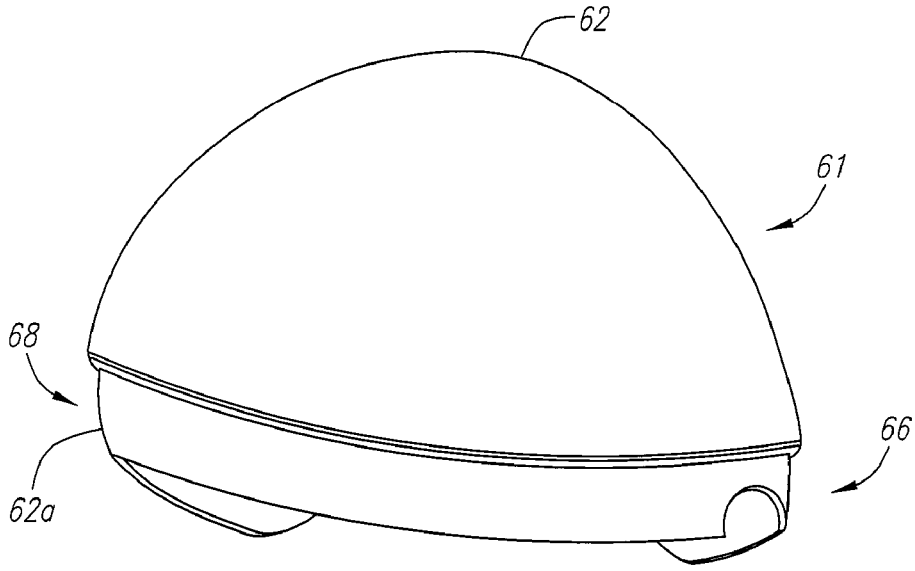
FIG. 14 is an isolated top plan view of an aft-body of the golf club head.
Figure 14A:
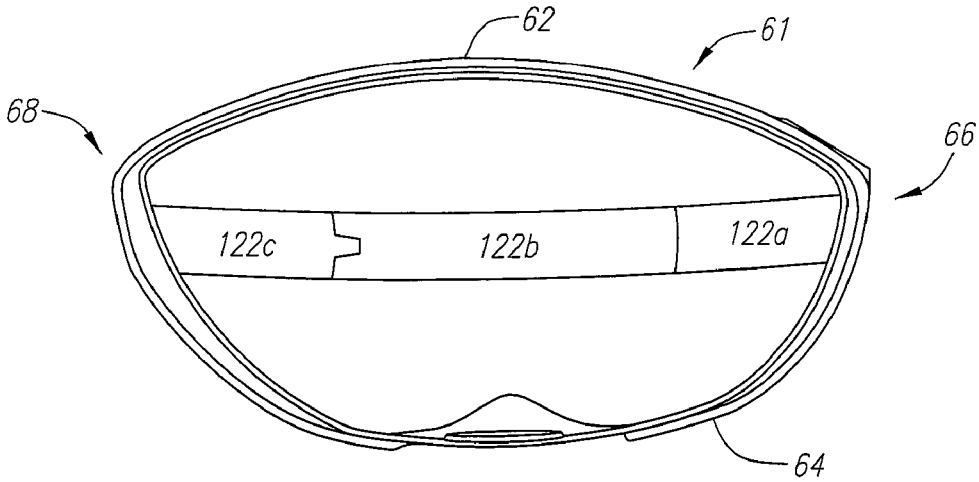
FIG. 14A is an interior view of the aft-body of FIG. 14.
Figure 14B:
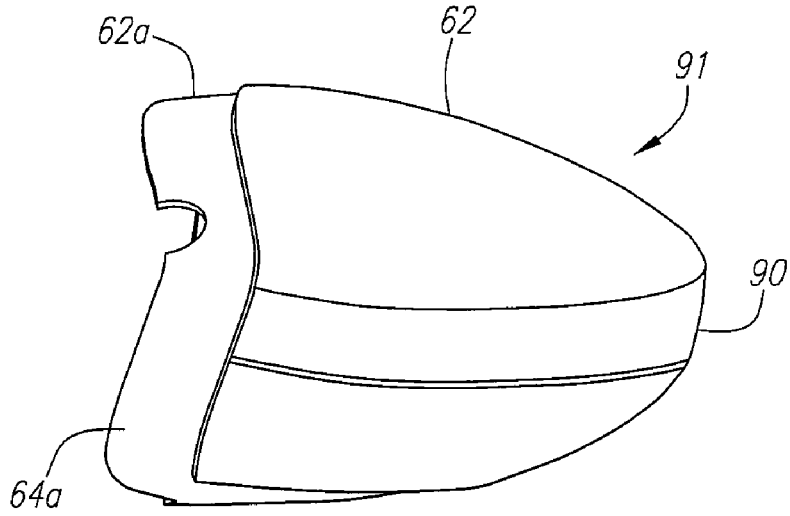
FIG. 14B is a heel side view of the aft-body of FIG. 14.
Figure 14C:
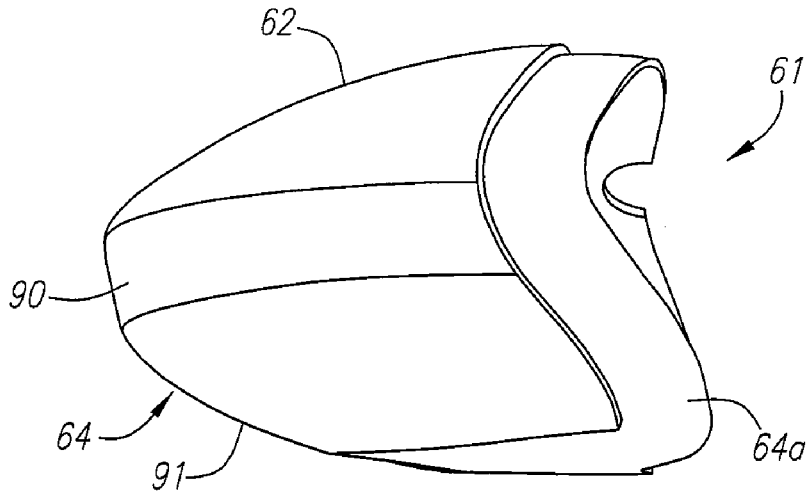
FIG. 14C is a toe side view of the aft-body of FIG. 14.
Figure 14D:
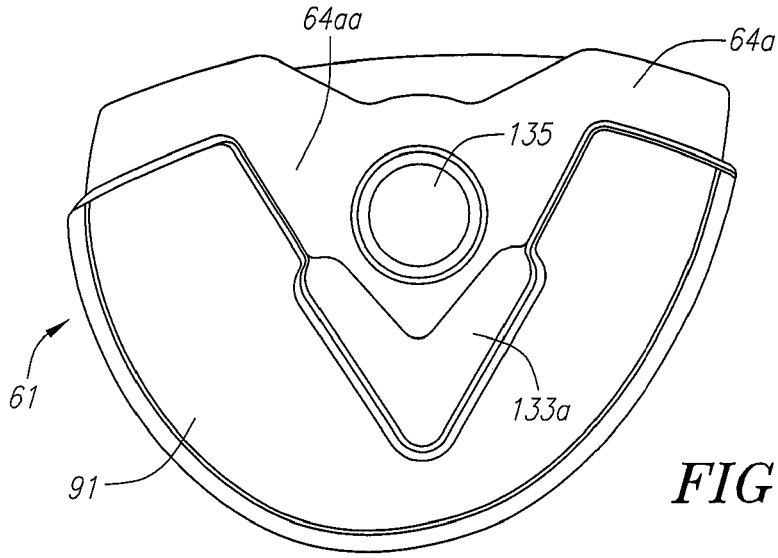
FIG. 14D is a bottom plan view of the aft-body of FIG. 14.
Figure 14E:
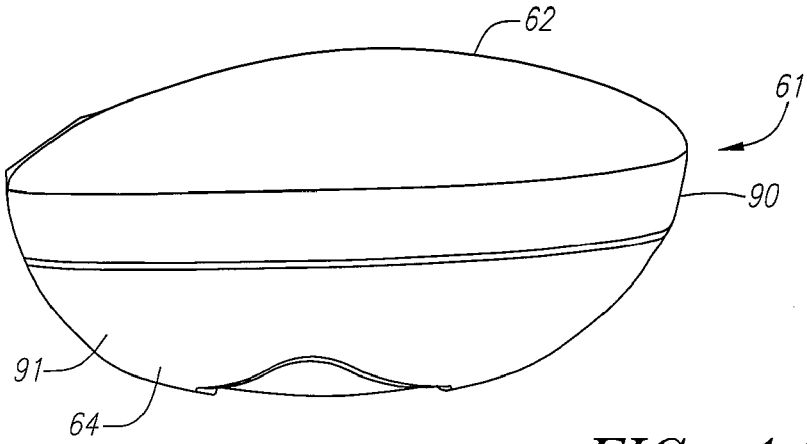
FIG. 14E is a rear view of the aft-body of FIG. 14.
Figure 14F:
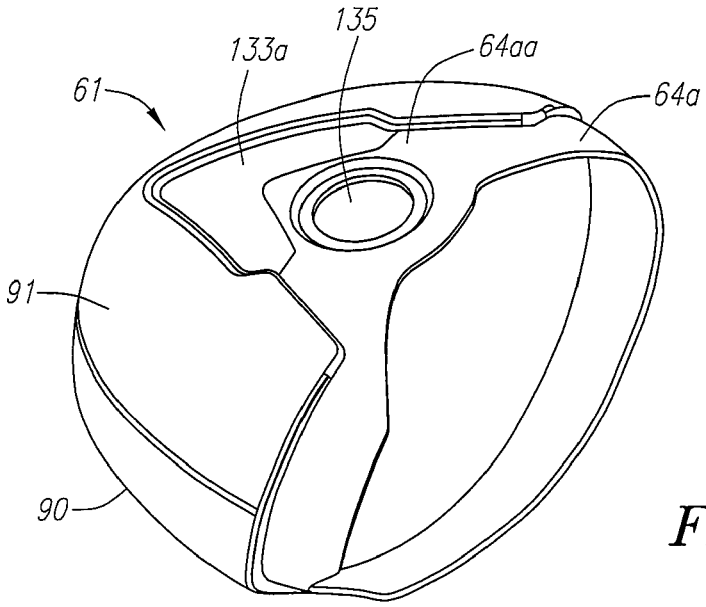
FIG. 14F is a bottom perspective view of the aft-body of FIG. 14.
Figure 15A:
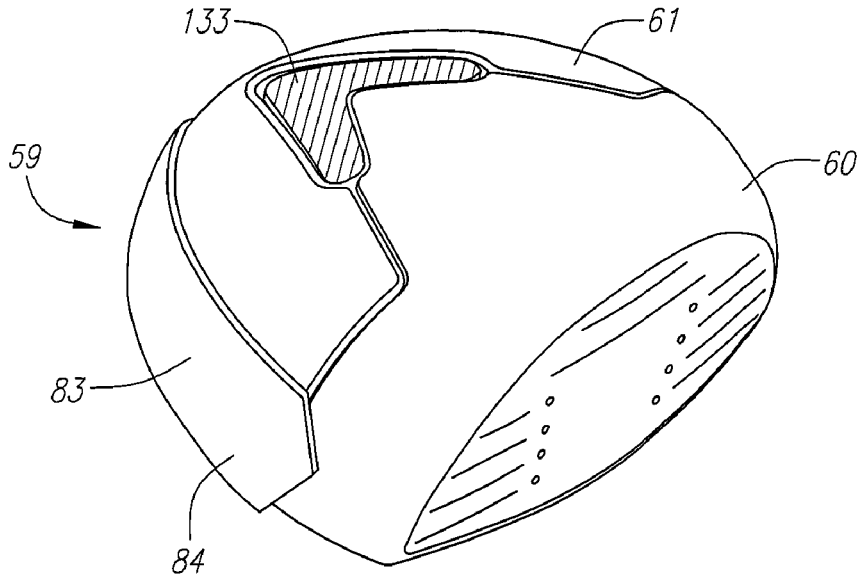
FIG. 15A is a bottom perspective view of the golf club head according to an example of a first embodiment of the present invention.
Figure 15B:
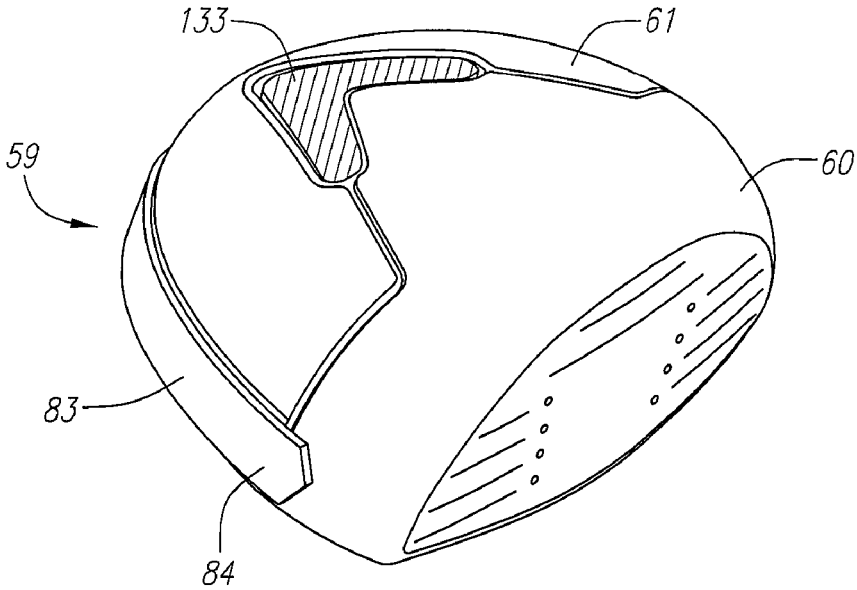
FIG. 15B is a bottom perspective view of the golf club head according to another example of the first embodiment of the present invention.

FIG. 13A illustrates a preferred embodiment of the face component of the golf club head 42. FIG. 13A illustrates the variation in the thickness of the striking plate portion 72. The striking plate portion 72 is preferably partitioned into elliptical regions, each having a different thickness. In a preferred embodiment in which the face component 60 is composed of a titanium or titanium alloy material, a central elliptical region 102 preferably has the greatest thickness that ranges from 0.120 inch to 0.090 inch, preferably from 0.115 inch to 0.100 inch, and is most preferably 0.105 inch. The central elliptical region 102 preferably has a uniform thickness. A first concentric region 104 preferably has the next greatest thickness that ranges from 0.110 inch to 0.076 inch, preferably from 0.100 inch to 0.086 inch, and is most preferably 0.088 inch. The first concentric region preferably has a thickness that transitions from the first concentric region 102 thickness to the periphery region 110 thickness. A periphery region 110 preferably has the next greatest thickness that ranges from 0.082 inch to 0.062 inch, and is most preferably 0.072 inch. The variation in the thickness of the striking plate portion 72 allows for the greatest thickness to be localized in the center 111 of the striking plate portion 72 thereby maintaining the flexibility of the striking plate portion 72 which corresponds to less energy loss to a golf ball and a greater coefficient of restitution without reducing the durability of the striking plate portion 72.

Also shown in FIG. 13A is an optional face component weighting section 113, which provides greater mass to the face component 60 for forward positioning of the center of gravity and heel and toe biasing of the golf club 40. The weighting section 113 is preferably an area of increased thickness. Alternatively, the weighting section 113 is an additional weight welded to the interior surface of the return portion 74 of the face component 60.

In a preferred embodiment, the return portion 74 generally includes an upper lateral section 76, a lower lateral section 78 with a sole extension 95, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel section 66 to the toe section 68. The upper lateral section 76 has a length from the perimeter 73 of the striking plate section 72 that is preferably a minimal length near the center of the striking plate section 72, and increases toward the toe section 68 and the heel section 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The present invention preferably has the face component 60 engage the crown 62 along a substantially horizontal plane. The crown 62 has a crown undercut portion 62*a*, which is placed under the return portion 74. Such an engagement enhances the flexibility of the striking plate portion 72 allowing for a greater coefficient of restitution.

The crown 62 and the upper lateral section 76 are attached to each other as further explained The heel lateral section 80 is substantially perpendicular to the striking plate portion 72, and the heel lateral section 80 covers the hosel 54 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d'", from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole 64, both the ribbon 90 and the bottom section 91, as explained in greater detail below. The toe lateral section 82 extends inward a distance, d", from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a distance, d', to engage the sole 64, and a sole extension 95 extends further inward a distance d.sup.s to preferably function as protection for the sole of the club head 42. In a preferred embodiment, the distance d' ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78. In a preferred embodiment, the distance d.sup.s ranges from 0.2 inch to 3.0 inches, more preferably 0.50 inch to 2.0 inches, and most preferably 1.50 inch, as measured from the edge of the lower lateral section 78 to an apex 97 of the sole extension 95. In a preferred embodiment, the sole extension is triangular in shape with minor apices 99. In an alternative embodiment, not shown, the sole extension 95 has a crescent shape. In yet a further alternative, not shown, the sole extension 95 has a rectangular shape, and extends to the ribbon 90. Those skilled in the pertinent art will recognize that the sole extension 95 may have various shapes and sizes without departing from the scope and spirit of the present invention.

The sole portion 64 has a sole undercut 64*a* for placement under the return portion 74. The sole extension 95 is disposed within a sole undercut extension 64*aa*. The sole 64 and the lower lateral section 78, the heel lateral section 80 and the toe lateral section 82 are attached to each other as explained in greater detail below.

As mentioned previously, the face component 60 is preferably forged from a rod of metal material. One preferred forging process for manufacturing the face component is set forth in U.S. Pat. No. 6,440,011, filed on Apr. 13, 2000, entitled Method For Processing A Striking Plate For A Golf Club Head, and hereby incorporated by reference in its entirety. Alternatively, the face component 60 is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged pre-form, and like manufacturing methods. Yet further methods include diffusion bonding titanium sheets to yield a variable face thickness face and then superplastic forming.

Alternatively, the face component 60 is composed of an amorphous metal material such as disclosed in U.S. Pat. No. 6,471,604, which was filed on Apr. 4, 2002 and is hereby incorporated by reference in its entirety.

Figure 7:
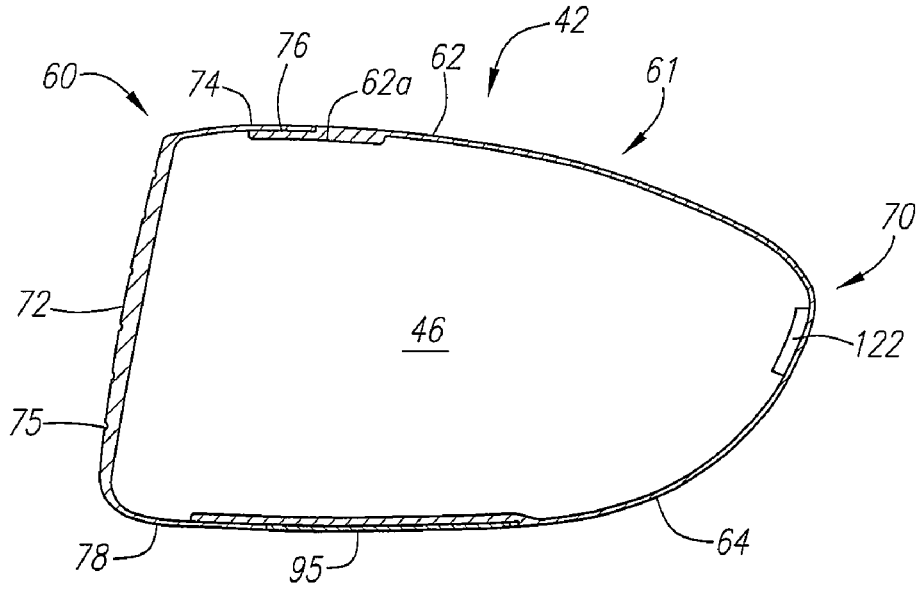
FIG. 7 is a cross-sectional view along line 7-7 of FIG. 5.

FIG. 7 illustrates the hollow interior 46 of the club head 42 of the present invention. The hosel 54 is disposed within the hollow interior 46, and is located as a part of the face component 60. The hosel 54 may be composed of a similar material to the face component 60, and is preferably secured to the face component 60 through welding or the like. The hosel 54 may also be formed with the formation of the face component 60. Additionally, the hosel may be composed of a non-similar material that is light weight and secured using bonding or other mechanical securing techniques. A hollow interior 118 of the hosel 54 is defined by a hosel wall 120 that forms a tapering tube from the aperture 59 to the sole potion 64. In a preferred embodiment, the hosel wall 120 does not engage the heel lateral section 80 thereby leaving a void 115 between the hosel wall 120 and the heel lateral section 80. The shaft 48 is disposed within a hosel insert 121 that is disposed within the hosel 54. Such a hosel insert 121 and hosel 54 are described in U.S. Pat. No. 6,352,482, filed on Aug. 31, 2000, entitled Golf Club With Hosel Liner, which pertinent parts are hereby incorporated by reference. Further, the hosel 54 is preferably located rearward from the striking plate portion 72 in order to allow for compliance of the striking plate portion 72 during impact with a golf ball. In one embodiment, the hosel 54 is disposed 0.125 inch rearward from the striking plate portion 72.

FIGS. 14, 14A, 14B, 14C, 14D, 14E and 14F illustrate the aft-body 61 in isolation. The aft-body 61 is composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. The aft-body 61 may be manufactured through bladder-molding, resin transfer molding, resin infusion, injection molding, compression molding, or a similar process. In a preferred process, the face component 60, with an adhesive on the interior surface of the return portion 74, is placed within a mold with a preform of the aft-body 61 for bladder molding. The return portion 74 is placed and fitted into the undercut portions 62*a* and 64*a*. Also, the adhesive may be placed on the undercut portions 62*a* and 64*a*. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

A bladder is placed within the hollow interior of the preform and face component 60, and is pressurized within the mold, which is also subject to heating. The co-molding process secures the aft-body 61 to the face component 60. Alternatively, the aft-body 61 is bonded to the face component 60 using an adhesive, or mechanically secured to the return portion 74.

The crown portion 62 of the aft-body 61 is generally convex toward the sole portion 64, and engages the ribbon 90 of the sole portion 64 outside of the engagement with the face component 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The under-cut portions 62*a*, 64*a*, 64*aa* and 133*a* have a similar thickness to the sole portion 64 and the crown portion 62. In a preferred embodiment, the aft-body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety. The bottom section 91 is generally convex toward the crown portion 62. An optional bladder port 135 is located in the sole undercut portion 64*a*.

Figure 8:
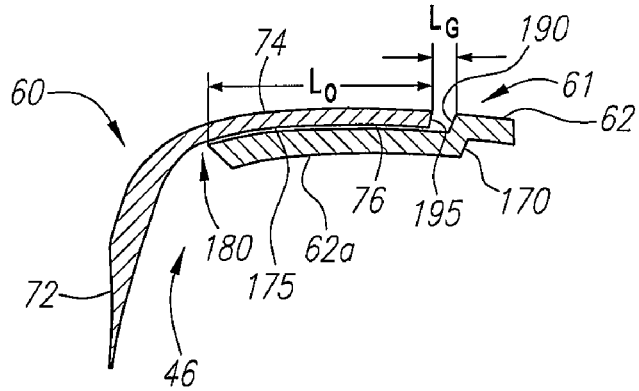
FIG. 8 is an isolated cross-sectional view of the face component overlapping the aft body.
Figure 9:
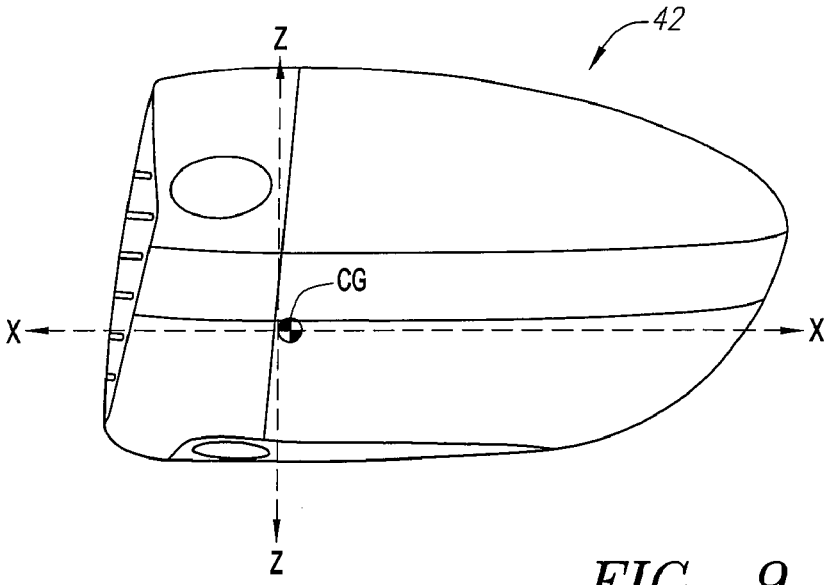
FIG. 9 is a heel side plan view of a golf club of the present invention illustrating the Z axis and X axis.

As shown in FIG. 8, the return portion 74 of the face component 60 overlaps the undercut portions 62*a* and 64*a* a distance Lo, which preferably ranges from 0.25 inch to 1.00 inch, more preferably ranges from 0.40 inch to 0.70 inch, and is most preferably 0.50 inch. An annular gap 170 is created between an edge 190 of the crown portion 62 and the sole portion 64, and an edge 195 of the return portion 74. The annular gap 170 preferably has a distance Lg that preferably ranges from 0.020 inch to 0.100 inch, more preferably from 0.050 inch to 0.070 inch, and is most preferably 0.060 inch. A projection 175 from an upper surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive 200 preferably secures the aft body 61 to the face component 60. A leading edge 180 of the undercut portions 62*a* and 64*a* may be sealed to prevent the liquid adhesive from entering the hollow interior 46.

Figure 16:
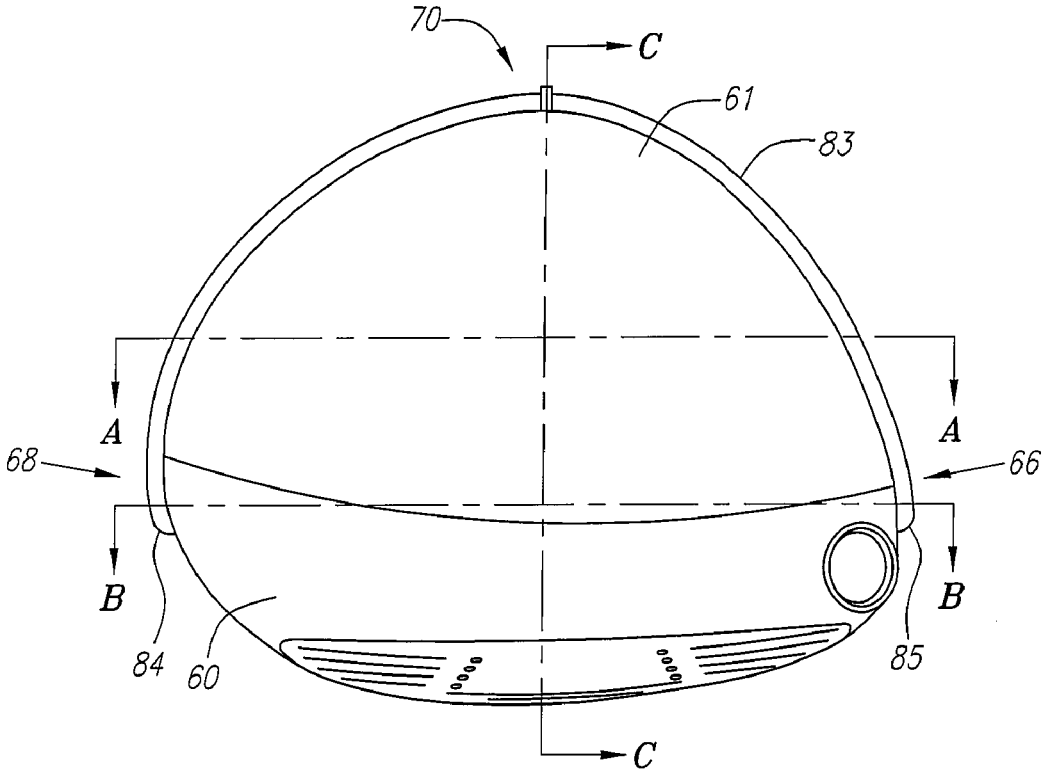
FIG. 16 is a top plan view of the golf club head of FIG. 15A.
Figure 16A:
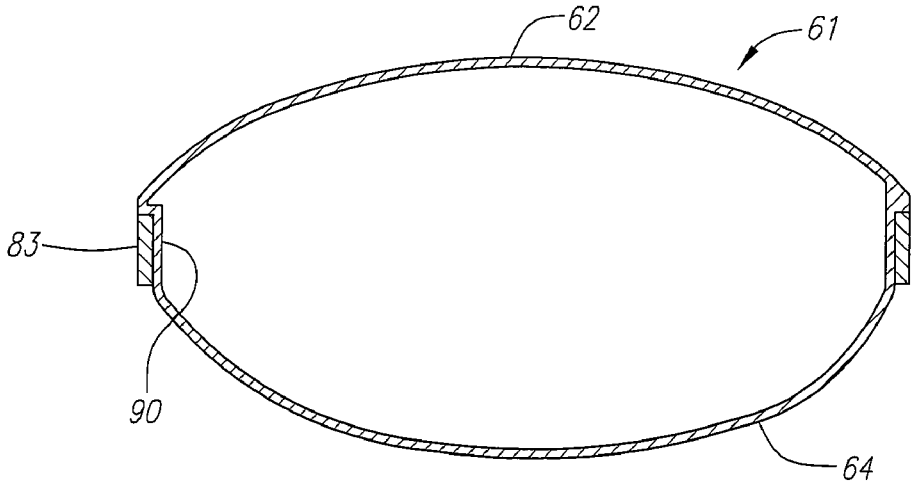
FIG. 16A is a cross-sectional view taken generally along the line A-A of FIG. 16.
Figure 16B:
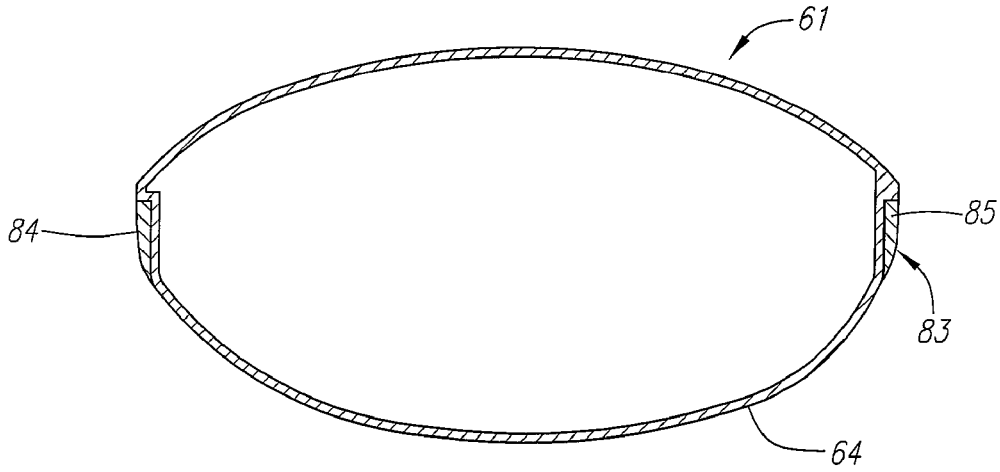
FIG. 16B is a cross-sectional view taken generally along the line B-B of FIG. 16.
Figure 16C:
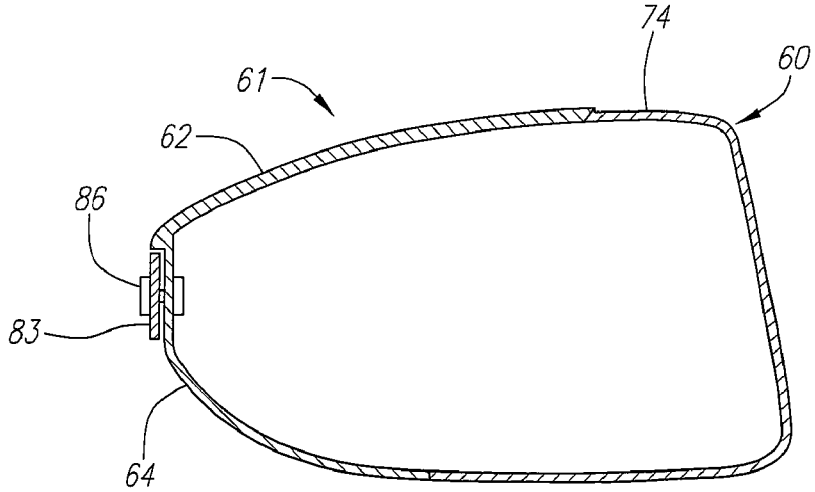
FIG. 16C is a cross-sectional view taken generally along the line C-C of FIG. 16.
Figure 17A:
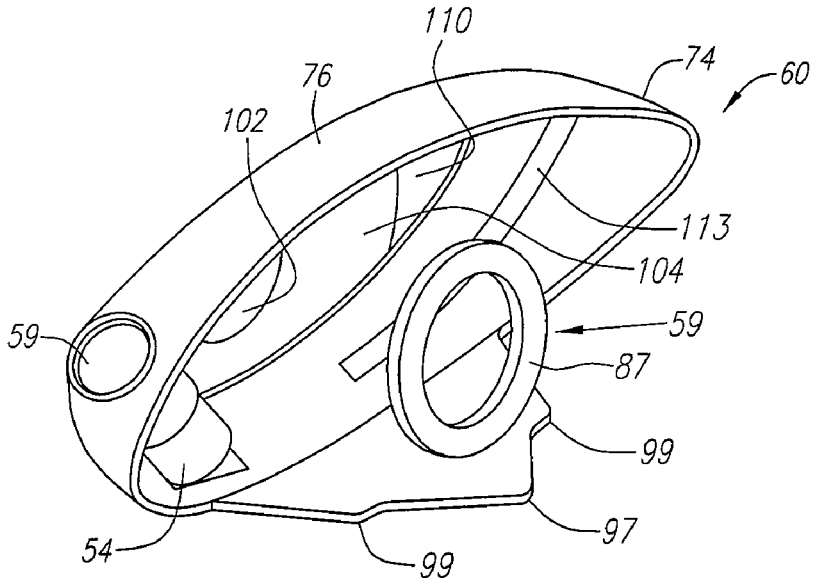
FIG. 17A is a rear perspective view of the face component with a sound modifying component joined thereto according to a second embodiment of the present invention.
Figure 17B:
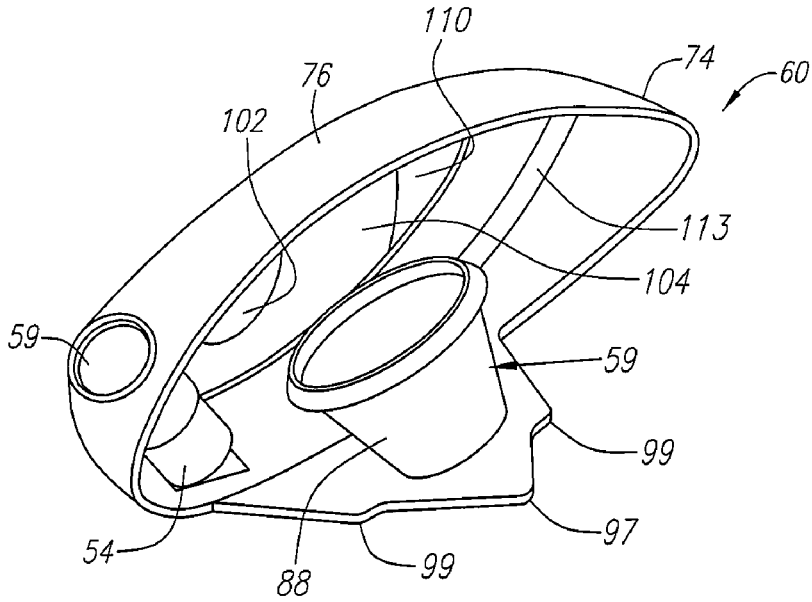
FIG. 17B is a rear perspective view of an alternative sound modifying component joined to the face component of the golf club head according to the second embodiment of the present invention.

As shown in FIGS. 15A, 15B, 16, 16A, 16B and 16C, in accordance with a first embodiment of the invention, the golf club head 42 includes an externally located sound modifying component 59. The sound modifying component 59 may be a wide (FIG. 15A) or narrow (FIG. 15B) arcuate piece 83 of metal attached to the exterior surface of the face component 60. The arcuate piece 83 has a first end 84 that is attached to the face component 60 at the heel end. The metallic arcuate piece 83 is preferably welded to the face component 60. Alternatively, the arcuate piece 83 may be secured to the face component 60 using a mechanical fastener or other attachment process. The arcuate piece 83 extends from the heel section 66 around the aft-body 60 to the toe section 68. The arcuate piece 83 preferably extends along the ribbon section 90 of the aft-body 61. The arcuate piece 83 may also be attached to the aft-body 61 with a fastener 86. The fastener 86 is preferably located approximately halfway across the ribbon section 90 at the rear section 70 of the aft-body 61. Aside from the connection points at first and second ends, 84 and 85 and fastener 86, the arcuate piece 83 is detached and spaced apart from the aft-body, as illustrated in FIG. 16A, to allow the arcuate piece 83 to vibrate. The fastener 86 may be provided to limit dampening, and to achieve the preferred sound characteristics.

The metallic arcuate piece 83 has a thickness in the range of 0.050 to 0.25 inch and a width in the range of 0.25 inch to 1.0 inch. The sound modifying component 59 is generally composed of a metal material, preferably a titanium material, including pure titanium and titanium alloys such as 6-4 titanium alloy, SP-700 titanium alloy (available from Nippon Steel of Tokyo, Japan), DAT 55G titanium alloy available from RTI International Metals of Ohio, and the like. Other metals for the sound modifying component 59 include stainless steel, other high strength steel alloy metals and amorphous metals.

FIGS. 17A and 17B illustrate variations of a second embodiment of the present invention. Like the first embodiment, the golf club head 42 includes a face component 60 and an aft-body 61 as described above. The golf club head 42 further includes a sound modifying component 59, which is located on an interior surface of the face component 60, rather than on the exterior surface as provided in the first embodiment. In FIG. 17A the sound modifying component 59 is shown as a ring or washer 87 attached to the interior surface of the sole extension 59 is shown as a ring or washer 87 attached to the interior surface of the sole extension 95 of the face component 60. In FIG. 17B, the sound modifying component 59 is a conical object 88 attached to the sole extension 96. One of ordinary skill in the art will appreciate that the sound modifying component 59 need not be limited to a ring or conical object as shown in 17A and 17B, but may be any suitable shape attached to the interior surface component 60. Preferably, the sound modifying component 59 has a height in the range of 0.25 inch to 1.00 inch, a width in the range of 0.25 inch to 1.50 inch, and a thickness in the range of 0.05 inch to 0.25 inch.

The sound modifying component 59 is preferably joined to the sole extension 95 using a welding, e-beam, or similar process known to the industry. Alternatively the sound modifying component 59 may be secured to the face component 60 using an adhesive or mechanical fastener. Preferably, the distance between the perimeter 73 and the edge of the sound modifying component 59 is in the range from 0.25 inch to 1.8 inches.

The sound modifying component 59 is generally composed of a metal material, preferably a titanium material, including pure titanium and titanium alloys such as 6-4 titanium alloy, SP-700 titanium alloy (available from Nippon Steel of Tokyo, Japan), DAT 55G titanium alloy available from RTI International Metals of Ohio, and the like. Other metals for the sound modifying component 59 include stainless steel, other high strength steel alloy metals and amorphous metals.

The aft-body 61 may include an optional rear weighting member 122 disposed within the hollow interior 46 of the club head 42 to increase the moment of inertia and control the center of gravity of the golf club head 42. Additionally, the weighting member 122 may be comprised of three weighting components 122*a*, 122*b*, and 122*c*, with each of the components being preferably composed of a polymer material integrated with a metal material. The metal material is preferably selected from copper, tungsten, steel, aluminum, tin, silver, gold, platinum, or the like. The polymer material is a thermoplastic or thermosetting polymer material.

The golf club head 42 of the present invention has modified characteristics for altered sound performance. According to one test, a golf ball is hit by a golf club with a head speed of approximately 100 miles per hour. The sound created by the impact is measured, and the sound's duration, amplitude, and pitch are recorded. The sound duration is equal to the amount of time taken for the amplitude of the impact sound to fall below 25 decibels. The measured amplitude is the RMS amplitude of the sound for the first 50 milliseconds. The pitch is measured using the average frequency content of the recorded sound.

TABLE ONE

| Example | Duration (milliseconds) | RMS Sound Pressure Level (dBA) | Pitch (Center Frequency, Hz) |
|---|---|---|---|
| 1 | 5.9 | 96.6 | 4400 |
| 2 | 4.0 | 94.9 | 3600 |
| 3 | 5.9 | 95.3 | 4000 |
| 4 | 6.3 | 97.8 | 4300 |
| 5 | 7.7 | 96.9 | 4100 |

Table One discloses the sound measurements for several golf cub heads. Example 1 is an existing golf club head having a metallic face component and a non-metallic after body. The club head in Example 1 does not have a sound modifying component. Examples 2-5 are sample golf club heads of the present invention, as illustrated in FIGS. 1-17B. All of the golf club heads of the present invention have a sound duration between 4 milliseconds and 8 milliseconds, a RMS sound pressure level between 94 decibels and 98 decibels, and a pitch in the range between 3500 Hertz and 4500 Hertz.

Example 2 is a golf club head according to the first embodiment of the invention, with a metallic face component, a noon-metallic aft-body, and a narrow external arcuate piece having a thickness of approximately 0.188 inch and a width of approximately 0.375 inch.

Example 3 is a golf club head according to the first embodiment of the invention, with a metallic face component, non-metallic aft-body, and a wide external arcuate piece having a thickness of approximately 0.188 inch and a width of approximately 1.0 inch.

Example 4 is a golf club head according to the second embodiment of the invention, with the golf club head comprising a metallic face component, a non-metallic aft-body, and ring welded to the interior surface of the sole extension of the face component. The ring has an outer radius of approximately 1.250 inches, an inner radius of 0.875 inches, and a thickness of 0.125 inch.

Example 5 is a golf club head according to the second embodiment of the current invention, with the golf club head comprising a metallic face component, a non-metallic aft-body, and conical piece welded to the interior surface of the sole extension of the face component. The conical piece has a greater radius approximately 1.250 inches, the lesser radius being approximately 0.50 inch, and a thickness of 0.188 inch.

The golf club heads of the present invention have modified sound characteristics as compared to a similar golf club head lacking the sound modifying component.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v2 - v1}{U1 - U2}$$

wherein U.sub.1 is the club head velocity prior to impact; U.sub.2 is the golf ball velocity prior to impact which is zero; v.sub.1 is the club head velocity just after separation of the golf ball from the face of the club head; v.sub.2 is the golf ball velocity just after separation of the golf ball from the face of the club head; and e is the coefficient of restitution between the golf ball and the club face. The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 of the present invention under standard USGA test conditions with a given ball ranges from approximately 0.81 to 0.94, preferably ranges from 0.83 to 0.883 and is most preferably 0.87.

Figure 1A:
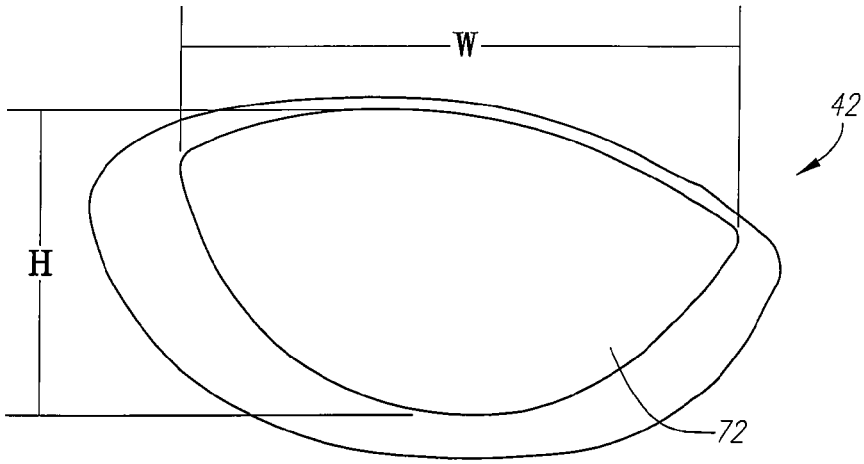
FIG. 1A is a front view of a golf club illustrating the measurement for the aspect ratio.
Figure 2:
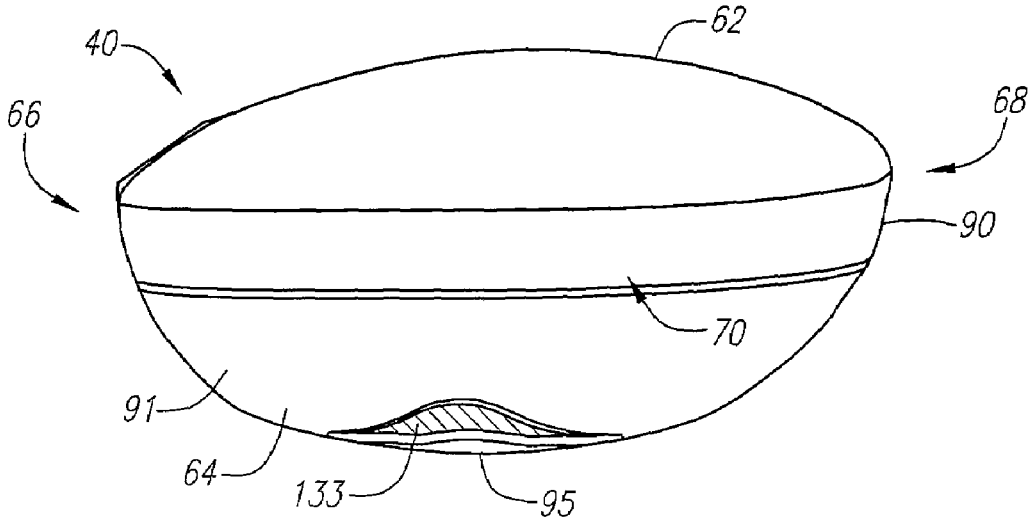
FIG. 2 is a rear view of a golf club head.
Figure 3:
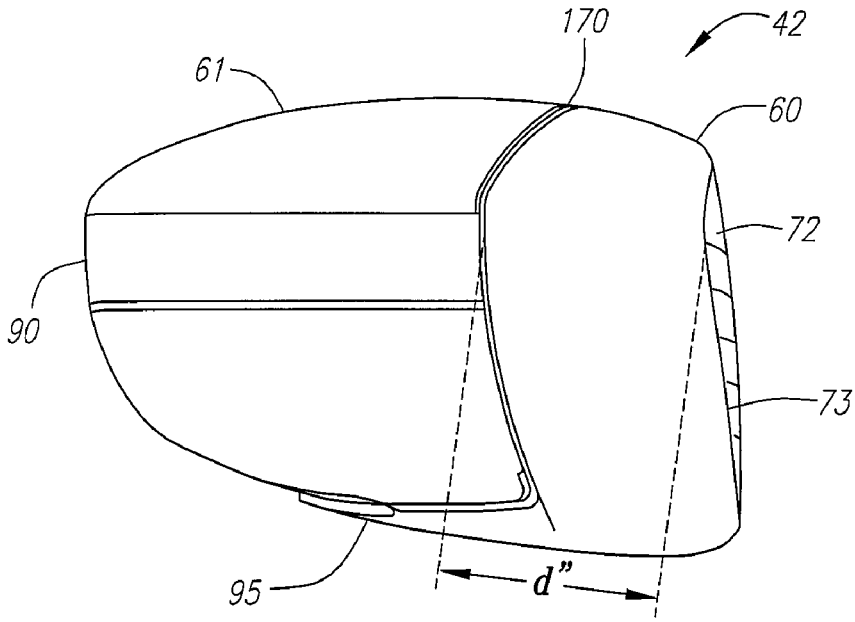
FIG. 3 is toe side view of the golf club head of FIG. 2.
Figure 4:
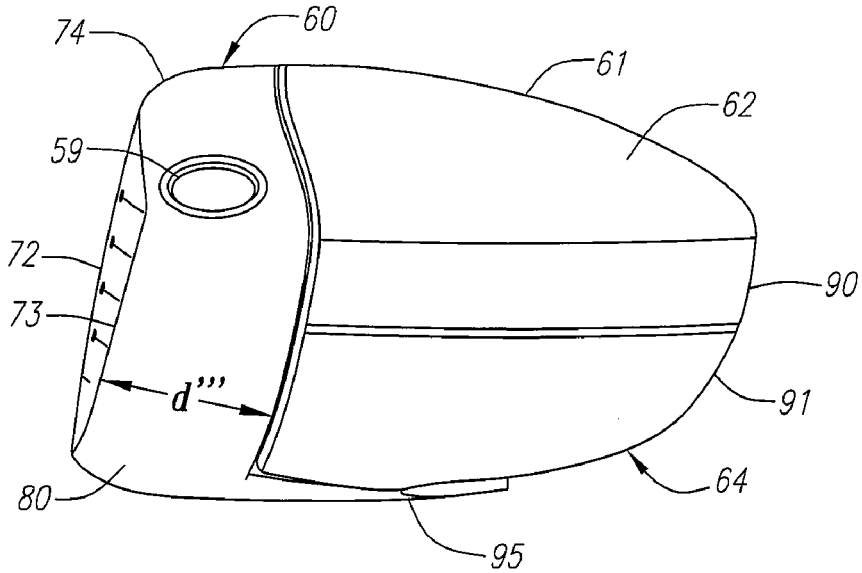
FIG. 4 is a heel side plan view of the golf club head of FIG. 2.
Figure 5:
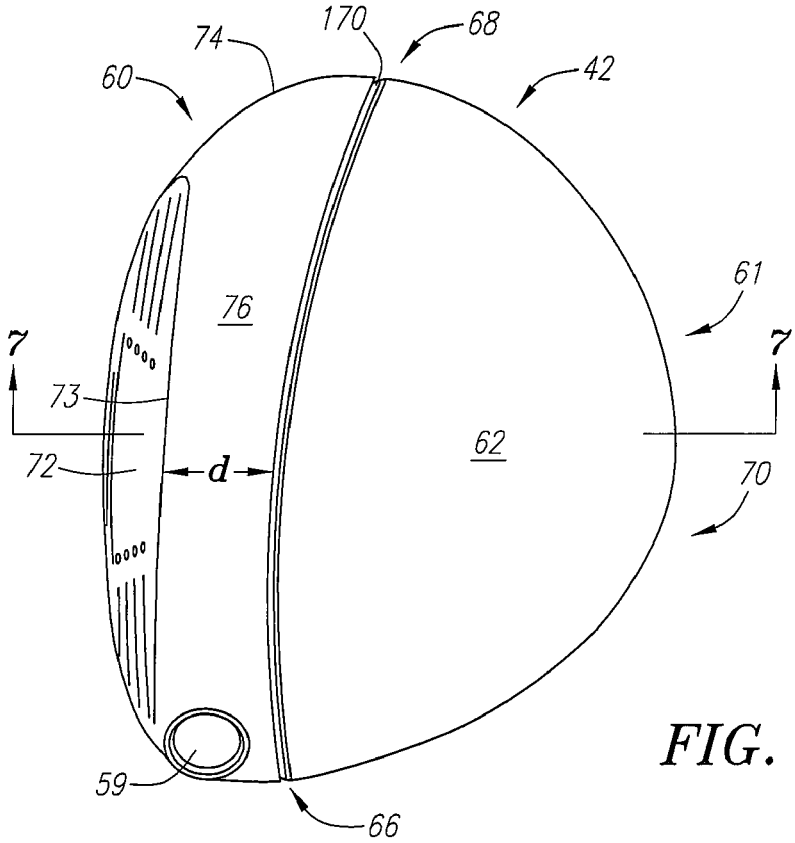
FIG. 5 is a top plan view of the golf club head of FIG. 2.
Figure 6:
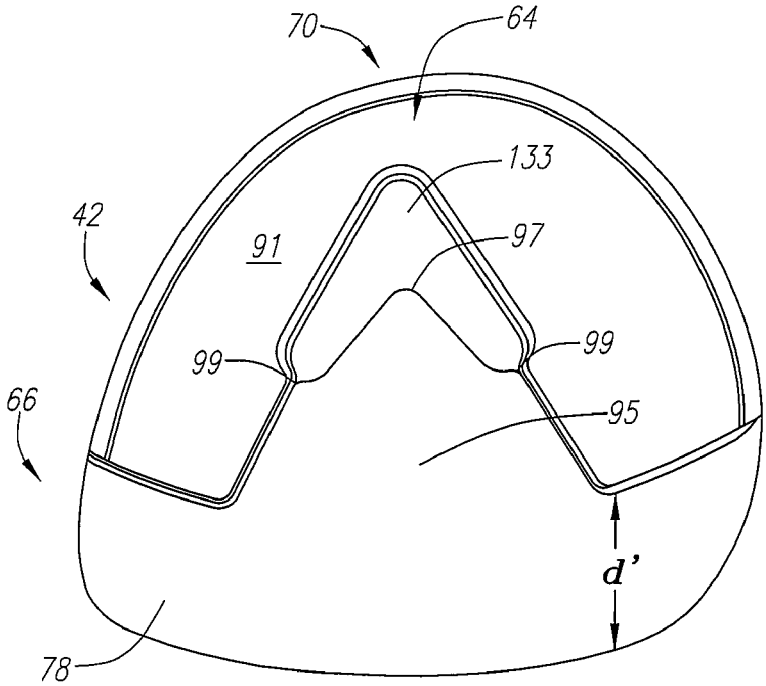
FIG. 6 is a bottom view of the golf club head of FIG. 2.

Additionally, the striking plate portion 72 of the face component 60 has a smaller aspect ratio than face plates of the prior art. The aspect ratio as used herein is defined as the width, "w", of the face divided by the height, "h", of the face, as shown in FIG. 1A. In one preferred embodiment, the width w is 78 millimeters and the height h is 48 millimeters giving an aspect ratio of 1.625. In conventional golf club heads, the aspect ratio is usually much greater than 1. For example, the original GREAT BIG BERTHA® driver had an aspect ratio of 1.9. The striking plate portion 72 of the present invention has an aspect ratio that is no greater than 1.7. The aspect ratio of the present invention preferably ranges from 1.0 to 1.7. One embodiment has an aspect ratio of 1.3. The striking plate portion 72 of the present invention is more circular than faces of the prior art. The face area of the striking plate portion 72 of the present invention ranges from 4.00 square inches to 7.50 square inches, more preferably from 5.00 square inches to 6.5 square inches, and most preferably from 5.8 square inches to 6.0 square inches.

The club head 42 of the present invention also has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 350 cubic centimeters to 510 cubic centimeters, even preferably 360 cubic centimeters to 395 cubic centimeters, and most preferably 385 cubic centimeters.

The mass of the club head 42 of the present invention ranges from 165 grams to 225 grams, preferably ranges from 175 grams to 205 grams, and most preferably from 190 grams to 200 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting member 122 (preferably composed of three separate weighting members 122*a*, 122*b* and 122*c*) has a mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. Additionally, epoxy, or other like flowable materials, in an amount ranging from 0.5 grams to 5 grams, may be injected into the hollow interior 46 of the golf club head 42 for selective weighting thereof.

The depth of the club head 42 from the striking plate portion 72 to the rear section of the crown portion 62 preferably ranges from 3.0 inches to 4.5 inches, and is most preferably 3.5 inches. The height, "H", of the club head 42, as measured while in striking position, preferably ranges from 2.0 inches to 3.5 inches, and is most preferably 2.50 inches. The width, "W", of the club head 42 from the toe section 68 to the heel section 66 preferably ranges from 4.0 inches to 5.0 inches, and more preferably 4.4 inches.

Figure 10:
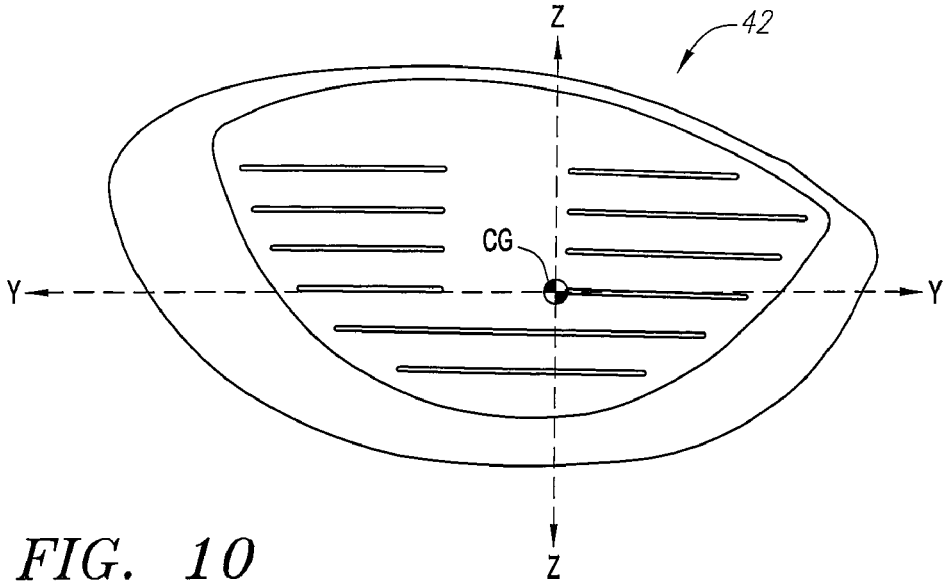
FIG. 10 is a front plan view of a golf club of the present invention illustrating the Z axis and Y axis.
Figure 11:
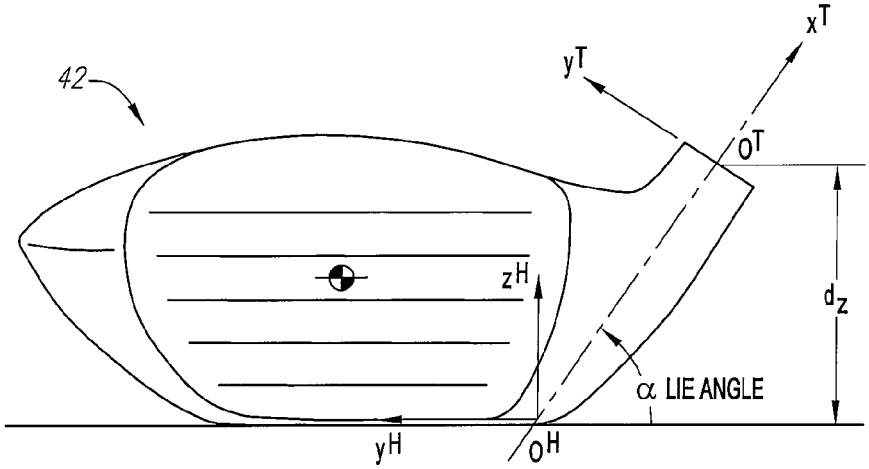
FIG. 11 is a front plan view of a golf club illustrating the test frame coordinates X.sup.T and Y.sup.T and transformed head frame coordinates Y.sup.H and Z.sup.H.
Figure 11A:
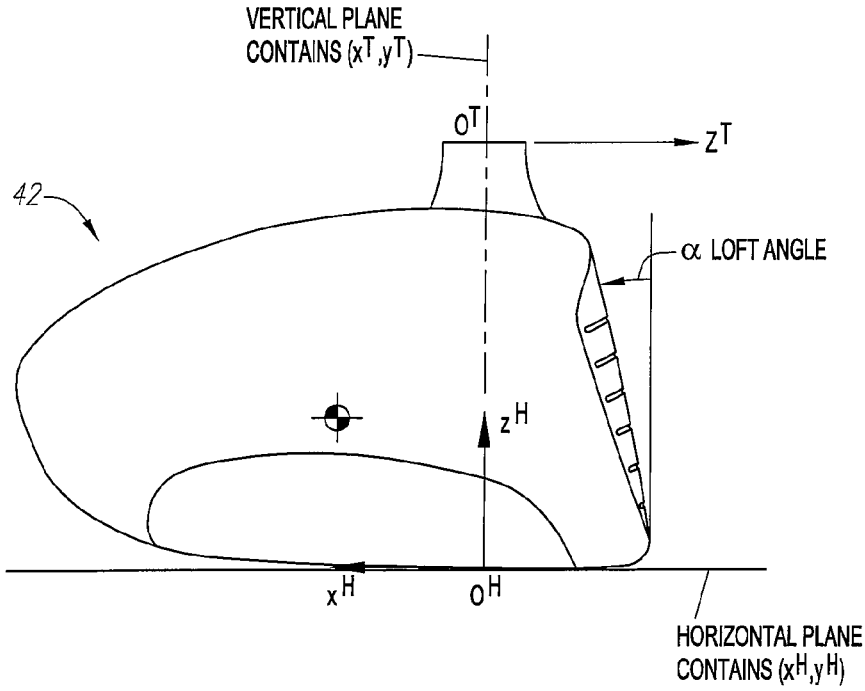
FIG. 11A is a toe end view of the golf club illustrating the test frame coordinate Z.sup.T and transformed head frame coordinates X.sup.H and Z.sup.H.
Figure 12:
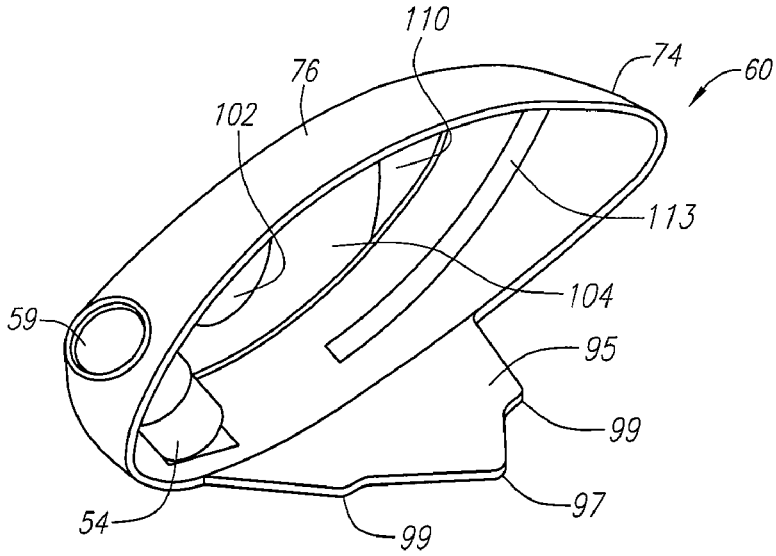
FIG. 12 is an isolated rear perspective view of a face component of the golf club.

FIGS. 10 and 10A illustrate the axes of inertia through the center of gravity of the golf club head. The axes of inertia are designated X, Y and Z. The X axis extends from the striking plate portion 72 through the center of gravity, CG, and to the rear of the golf club head 42. The Y axis extends from the toe section 68 of the golf club head 42 through the center of gravity, CG, and to the heel section 66 of the golf club head 42. The Z axis extends from the crown portion 62 through the center of gravity, CG, and to the sole portion 64.

In general, the moment of inertia, Izz, about the Z axis for the golf club head 42 of the present invention will range from 2800 g-cm.sup.2 to 5000 g-cm.sup.2, preferably from 3000 g-cm.sup.2 to 4500 g-cm.sup.2, and most preferably from 3750 g-cm.sup.2 to 4250 g-cm.sup.2. The moment of inertia, Iyy, about the Y axis for the golf club head 42 of the present invention will range from 1500 g-cm.sup.2 to 2750 g-cm-.sup.2, preferably from 2000 g-cm.sup.2 to 2400 g-cm.sup.2, and most preferably from 2100 g-cm.sup.2 to 2300 g-cm-.sup.2.

The golf club head 42 has products of inertia such as disclosed in U.S. Pat. No. 6,425,832, which was filed on Jul. 26, 2001 and is hereby incorporated by reference in its entirety. Preferably, each of the products of inertia, Ixy, Ixz and Iyz, of the golf club head 42 have an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

an aft-body composed of a plurality of plies of pre-preg material, the aft body comprising a crown portion and a sole portion;

a face component attached to the aft-body with an adhesive material, the face component composed of a metal material;

and a means for modifying the sound characteristics of the golf club head, the modifying means being attached to the face component, wherein the golf club head has a pitch ranging from 3500 Hertz to 4500 Hertz when striking a golf ball at a swing speed of approximately 100 miles per hour;

wherein the golf club head has a volume ranging from 350 cubic centimeters to 510 cubic centimeters, a depth ranging from 3.0 inches to 4.5 inches, a width ranging from 4.0 inches to 5.0 inches, a height ranging from 2.0 inches to 3.5 inches, a mass ranging from 165 grams to 225 grams, and a coefficient of restitution of 0.80 to 0.94.

2. The golf club head according to claim 1 wherein the means for modifying the sound characteristics is composed of a metal material.

3. The golf club head according to claim 2 wherein the metal material for the means for modifying the sound characteristics is selected from a group consisting of a titanium alloy, amorphous metal, stainless steel and maraging steel.

4. The golf club head according to claim 1, wherein the means for modifying the sound characteristics is attached to an interior surface of the face component.

5. The golf club head according to claim 4 wherein the means for modifying the sound characteristics is attached to the interior surface of the sole extension.

6. The golf club head according to claim 4 wherein the means of modifying the sound characteristics includes a ring.

7. The golf club head according to claim 4 wherein the means of modifying the sound characteristics includes a conical object.

8. The golf club head according to claim 1 wherein the means for modifying the sound characteristics of the golf club head are attached using a welding or e-beam process.

9. The golf club head according to claim 1 wherein, the means for modifying the sound characteristics is attached to an exterior surface of the face component.

10. The golf club head according to a claim 9 wherein the means for modifying the sound characteristics includes an arcuate piece having a first end and a second end, the first end being attached to the return portion of the face component at a toe end, the second being attached to the return portion at a heel end.

11. The golf club head according to claim 10 wherein the aft-body includes a ribbon portion located between the crown portion and the sole portion, the arcuate piece extending generally along the ribbon portion of the aft-body.

12. The golf club head according to claim 11 wherein a fastener secures the arcuate piece to a rear section of the ribbon portion, the arcuate piece being detached from the aft body except at the fastener.

* * * * *